United States Patent [19]

Fan

[11] Patent Number: 4,923,185

[45] Date of Patent: May 8, 1990

[54] VERTICAL-LIFT SCREW DRIVE MECHANISM

[76] Inventor: Chaolai Fan, 112 Stalin St., Changchun, Jilin Province, China

[21] Appl. No.: 240,963

[22] Filed: Sep. 6, 1988

[30] Foreign Application Priority Data

Sep. 4, 1987 [CN] China ..... 87213118
Nov. 28, 1987 [CN] China ..... 87108067
Aug. 8, 1988 [CN] China ..... 88104905

[51] Int. Cl.[5] ..... B25B 1/02
[52] U.S. Cl. ..... 269/181
[58] Field of Search ..... 74/424.8 R, 424.8 A; 269/178–179, 181–187, 189

[56] References Cited

U.S. PATENT DOCUMENTS 802,040 10/1905 Hanimann ..... 269/179
2,102,602 12/1937 Nash .
2,430,458 11/1947 Farrell .
2,672,776 3/1954 Elsenheimer .
3,669,440 6/1972 Kartasuk ..... 269/181

FOREIGN PATENT DOCUMENTS 639918 4/1962 Canada ..... 269/185

*Primary Examiner*—Robert C. Watson
*Attorney, Agent, or Firm*—Darby & Darby

[57] ABSTRACT

A vertical lift screw drive mechanism comprises a movable body, a stationary body, a screw, a screw nutseat, an eccentric cam, a ratchet sleeve, a guide key and a spring. The sleeve has a one-direction pawl matching a pawl groove on the cam end surface. The pawl drives the cam to rotate causing the screw to carry out a vertical up and down movement under an action of the cam, thus to engage with or disengage from the inner threads of the seat. On disengagement of the threads, push the movable body to slide fast along the guide track; on engagement of the threads, the screw may rotate to clamp a workpiece.

21 Claims, 12 Drawing Sheets

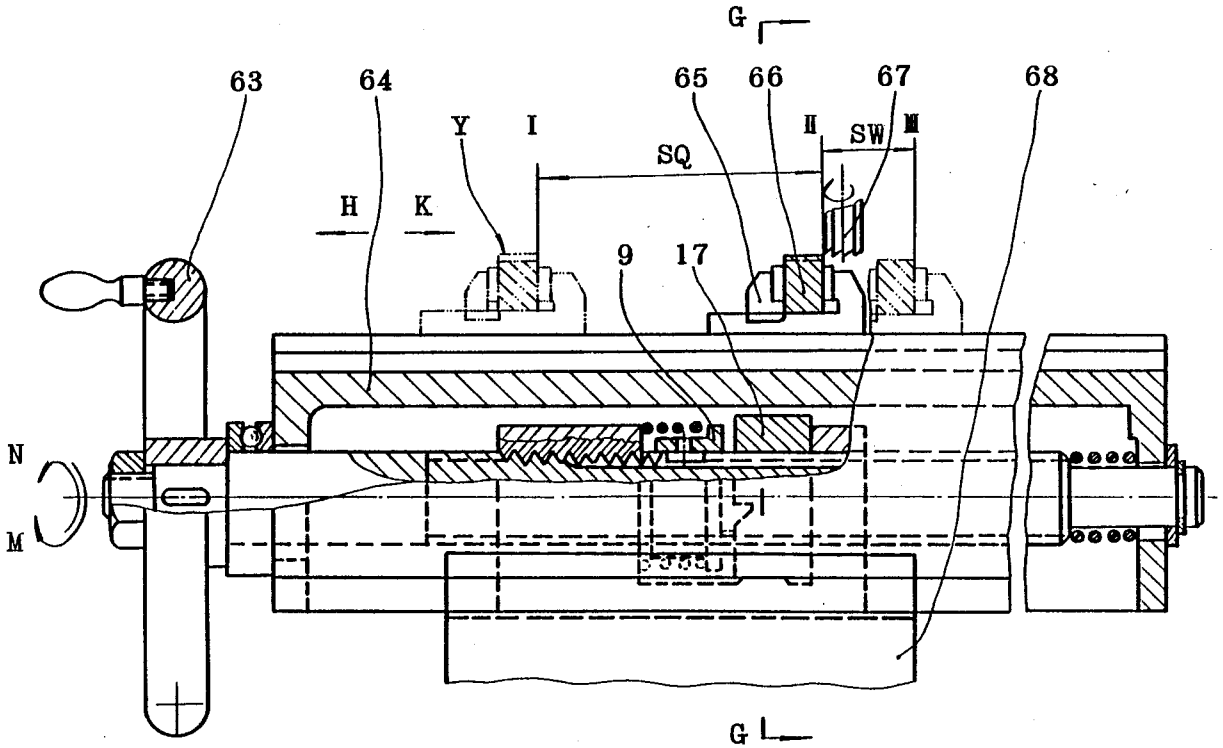
FIG. 9-I

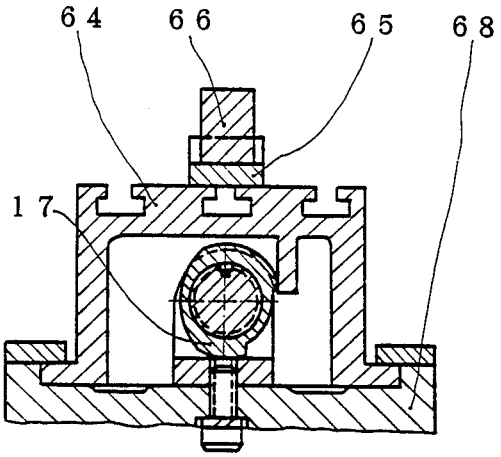
FIG. 9—IIG—G

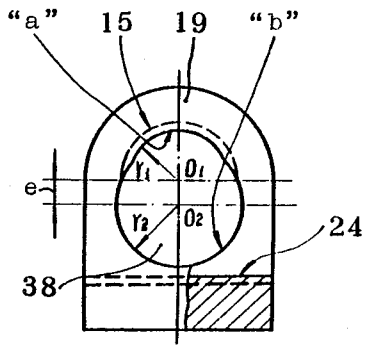
FIG. 4—II P
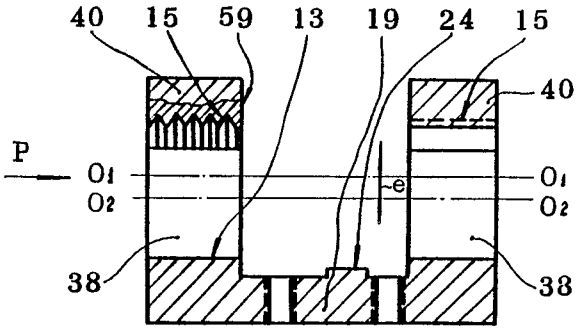
FIG. 4—I
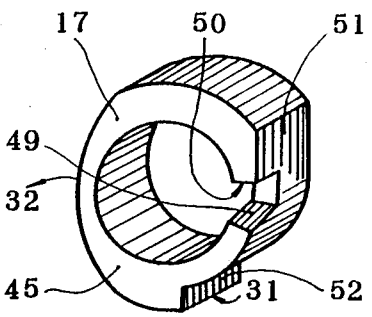
FIG. 6
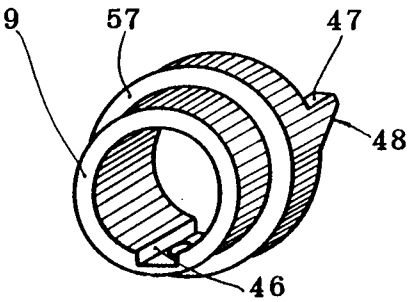
FIG. 5

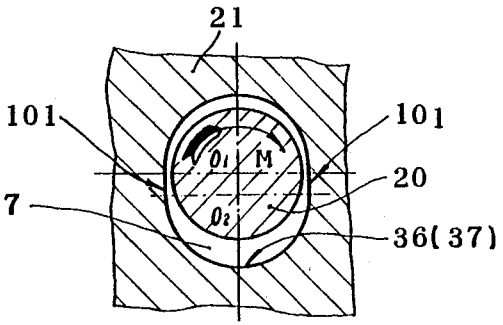
FIG. 8—I A'—A'(D—D)
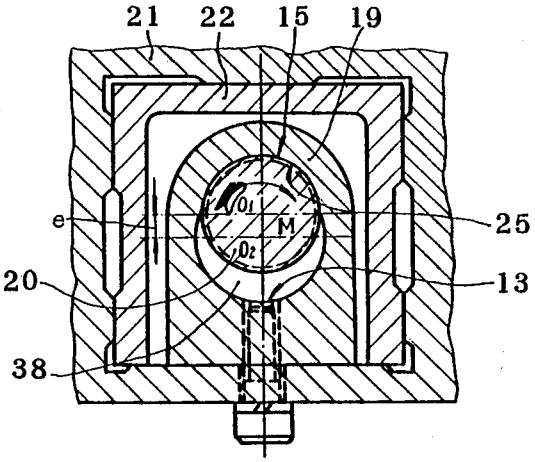
FIG. 8—II B'—B'
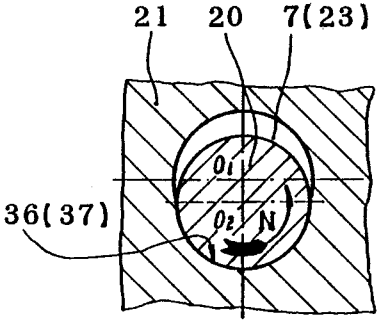
FIG. 7—I A—A(D—D)
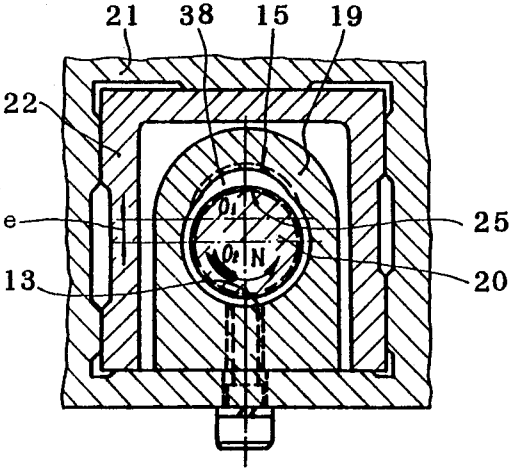
FIG. 7—II B—B

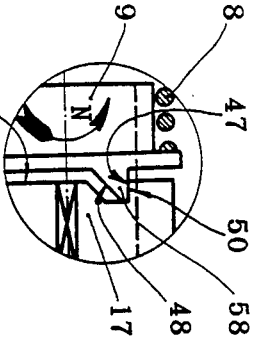
FIG. 7—Ⅲ E
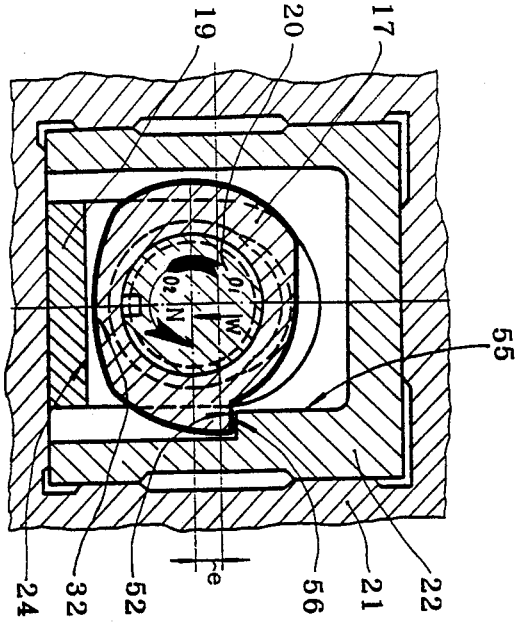
FIG. 7—Ⅳ C—C
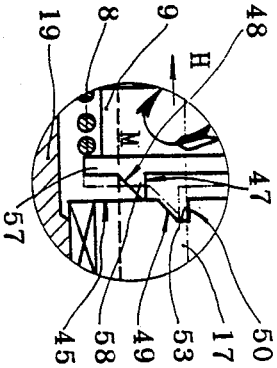
FIG. 8—Ⅲ E'
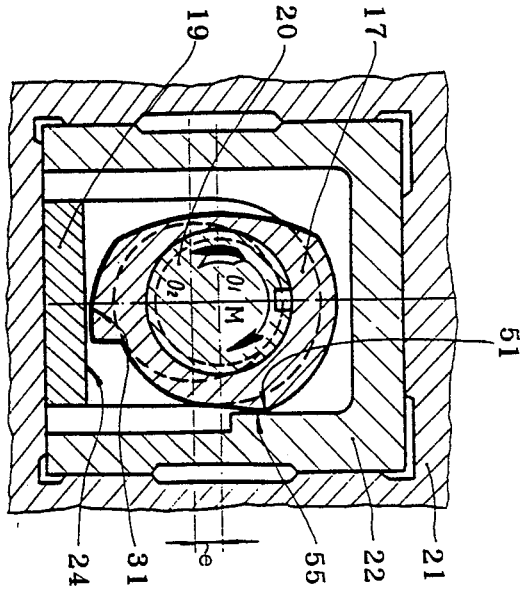
FIG. 8—Ⅳ C'—C'

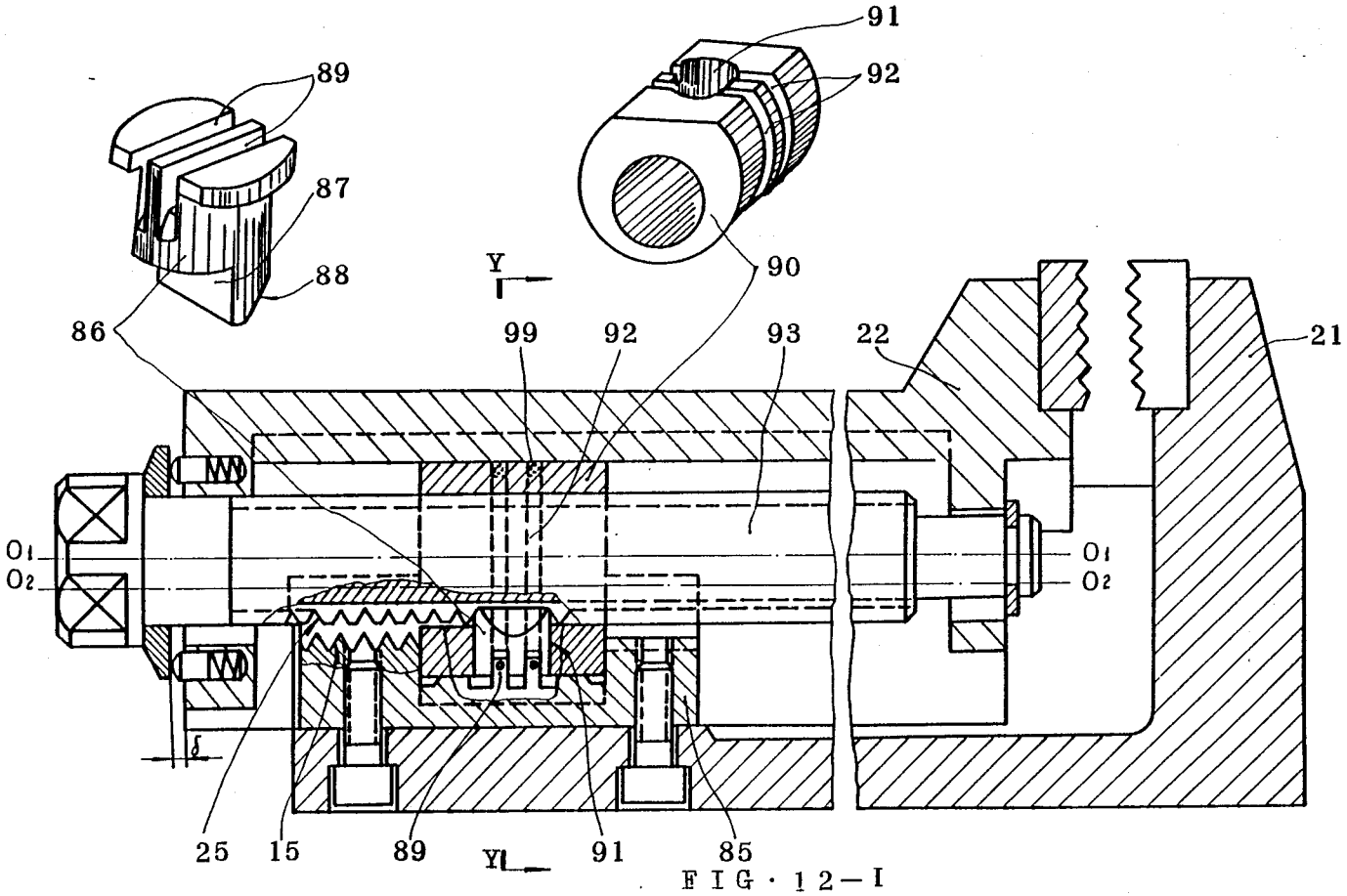
FIG. 12—I

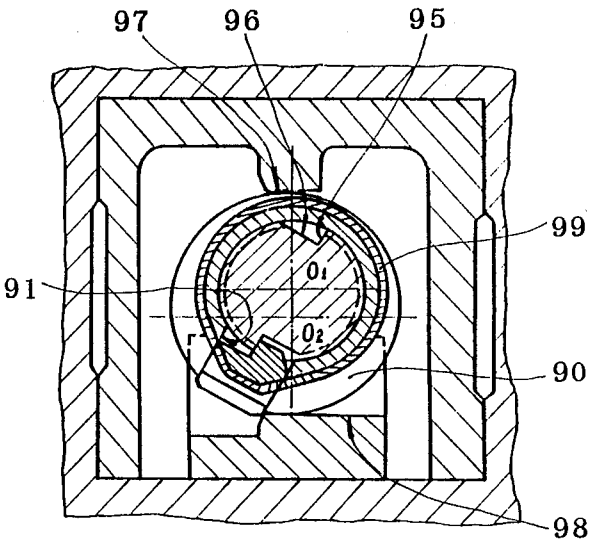
FIG. 12—IV
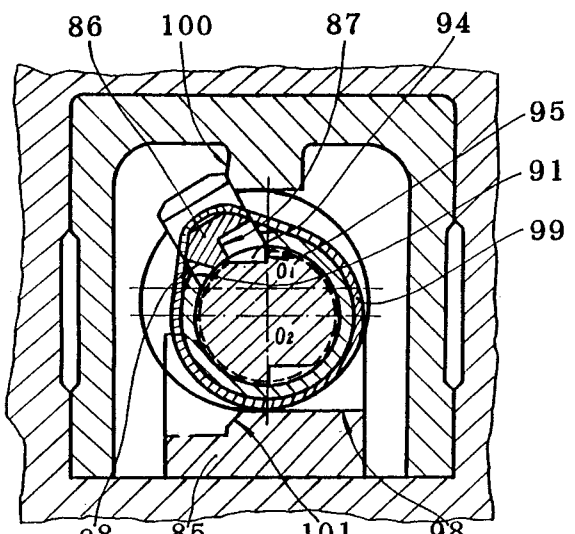
FIG. 12—III
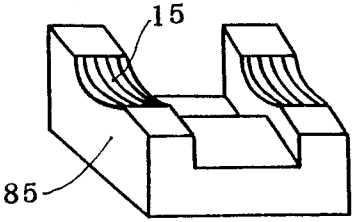
FIG. 12—II

VERTICAL-LIFT SCREW DRIVE MECHANISM

The present invention relates to a novel screw drive mechanism which permits the screw fast to engage with or disengage from a stationary screw nut by a vertical lifting of the screw and can be widely used in a manual bench vice, bench vice for a tool or sliding table of a tool where there are requirements for quickly passing over an idle stroke, speedily adjusting a relative distance or fast clamping.

There are many known types of fast splitting screw drive mechanism and the one being in common use is the type of splite screw nut (see FIG. I). However, it is used only in a narrow domain since the drive mechanism is very complex in construction. The U.S. Pat. No. 2102602(1937) disclosed a mechanism which the locus of center in the screw is an arc when the screw disengages or engages to the nut. Thus, the nut has to slidably connect with a stationary body, which would render a poor strength. The U.S. Pat. No. 2430458(1947) also discloses a mechanism in which the screw nut will still remain on the screw after the later has disengaged from the former and where the screw nut bears against to an outer circumference of the screw by a spring and a pin, which will bring a too great resistance. Moreover, the U.S. Pat. No. 2672776(1954) disclosds a mechanism that operation will employ simultaneously two handles and is inconvenient for working.

An object of the invention is to overcome the aforesaid drawbacks by employing a one-direction ratchet type cam mechanism to bring the screw moving vertically so that the stationary screw engaging with or disengaging from the stationary screw nut fast. This mechanism is simple in construction and is low in cost.

The mechanism according to the present invention comprises a movable sliding body, a stationary body, a screw, a screw nut seat, a cam, a ratchet sleeve, a spring and a guide key, where the screw posses through the cam and the ratchet sleeve while the two ends of the screw are supported in two long-circular holes in two end walls of the movable sliding body respectively. The ratchet sleeve is mounted between the eccentric cam and a arm of the screw nut seat and connects with the screw through the guide key. There is provided one or more one-direction clutch pawls on the end face of the sleeve and the pawl has a vertical surface and an oblique surface which may engage correspondingly with a vertical surface and an oblique surface on one or more pawl grooves of the eccentric cam. The sleeve is beared against on an end surface of the cam by a spring. In case of clamping workpiece, ture a handle clockwise to drive the screw and the ratchet sleeve in rotation simultaneously thus the oblique surface of pawl beares against the oblique surface of the pawl groove of the cam so as to rotate the cam, meanwhile, the screw is lifted under the action of an upward stroke curve in the cam and then the outer threads of the screw will engage with inner threads of the screw nut seat continuing to rotate the handle, a positioning plane of the cam will be arrested, which stops the rotation of the cam while the screw may continue to rotate righthandwise, thus, the pawl of the ratchet sleeve may produce an axial componental force under the action of the oblique surface on the cam pawl groove and the pawl will slide out from the groove when the axial component is greater than an axial pressure of the spring, since the screw engages with threads of the screws nut seat, the screw will displace forward when it rotates, and push the movable sliding body forward so as to achieve the goal for quickly clamping a workpiece. Similarly, in case of releasing a workpiece, ture the handle counterclockwise (left turning) to rotate the screw and ratchet sleeve, causing the pawl of the sleeve to fall into the cam pawl groove, the vertical surface of pawl touching the vertical surface of cam pawl groove pushes the cam to rotate in left, thus brings the screw to descend under an action of the downward stroke curve of the cam, so that the threads of the screw and screw nut seat disengage and then the movable body may be pulled or pushed freely to achieve an goal for fast adjusting (in about one second) the opening of the jaws in a vice.

The invention will be explained in the following by taking the bench vice as an embodiment in referring to the accompanying drawings.

FIG. 1 is a view showing a screw drive mechanism of split nut type in the prior art.

FIG. 2 illustrating a bench vice employing the drive mechanism according to the invention is a sectional view showing the bench vice in a released position.

FIG. 4I is a general view of the screw nut seat.

FIG. 4II is a side view of FIG. 4I.

FIG. 5 is a perspective view of the ratchet sleeve.

FIG. 6 is an perspective view of the eccentric cam.

Figure 1:
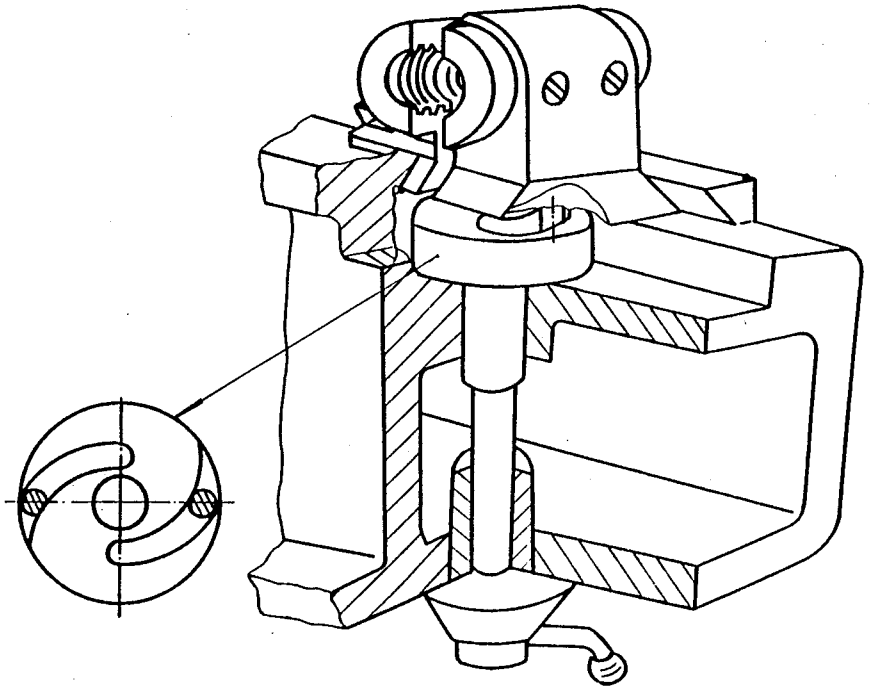
Figure 2:
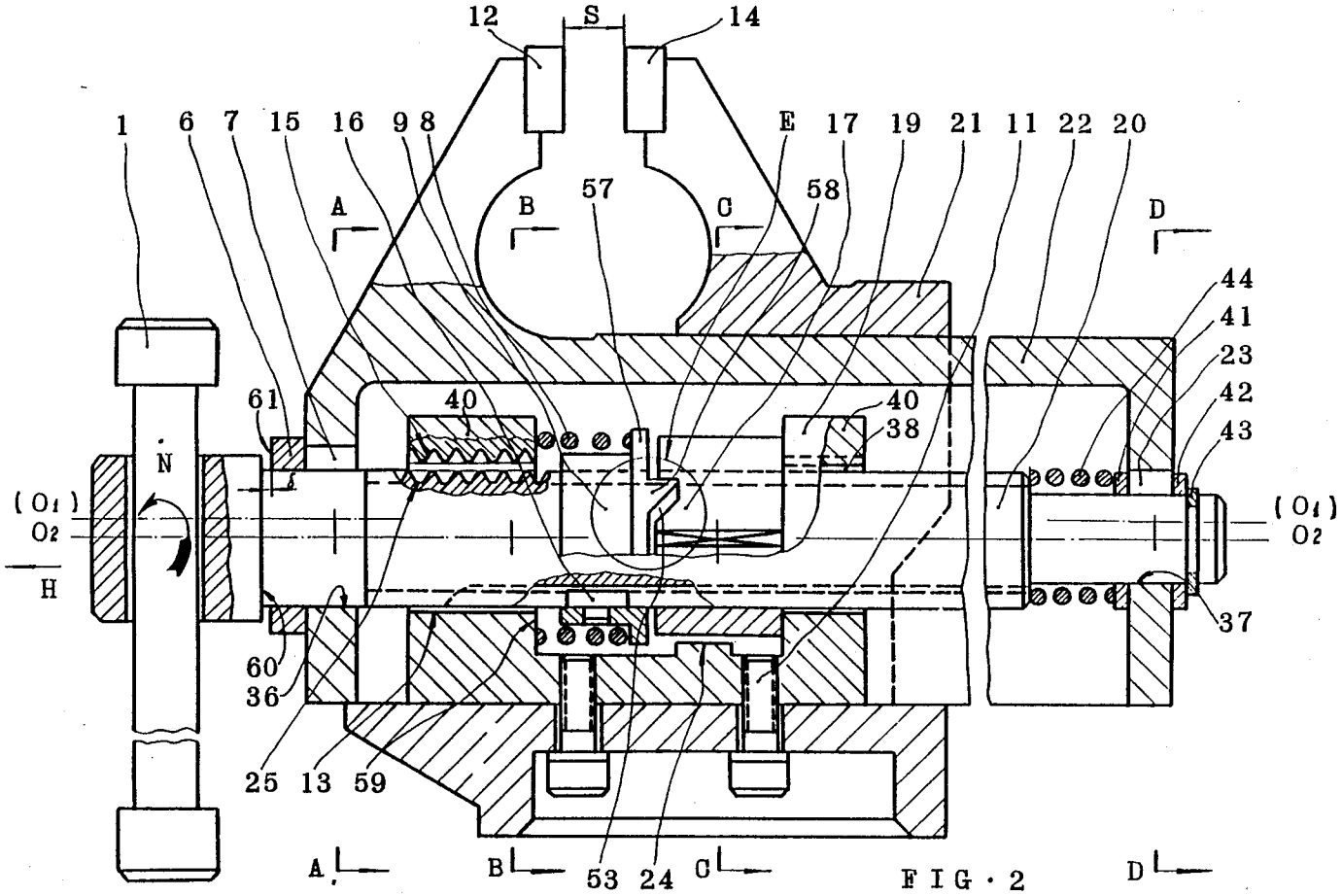

FIG. 7I is a sectional view of FIG. 2 taken from line AA and D—D, showing a relative position of the screw neck journal in the support holes of the front and back vertical plate of the movable body, when the bench vice is in a released position.

FIG. 7II is a sectional view of FIG. 2 taken from line BB, showing a relative position after the outer threads of screw having been disengaged from the inner threads of an axial hole in the screw nut seat, when the bench vice is in a released position.

FIG. 7III is an orthogonal projection drawing of the local view E showing the pawl of ratchet sleeve to engage with the pawl groove on the cam when the bench vice of FIG. 2 is in a released position.

FIG. 7IV is a sectional view taken from line CC of FIG. 2, showing relative position of the eccentric cam and the screw nut seat when the bench vice is in a released position.

Figure 3:
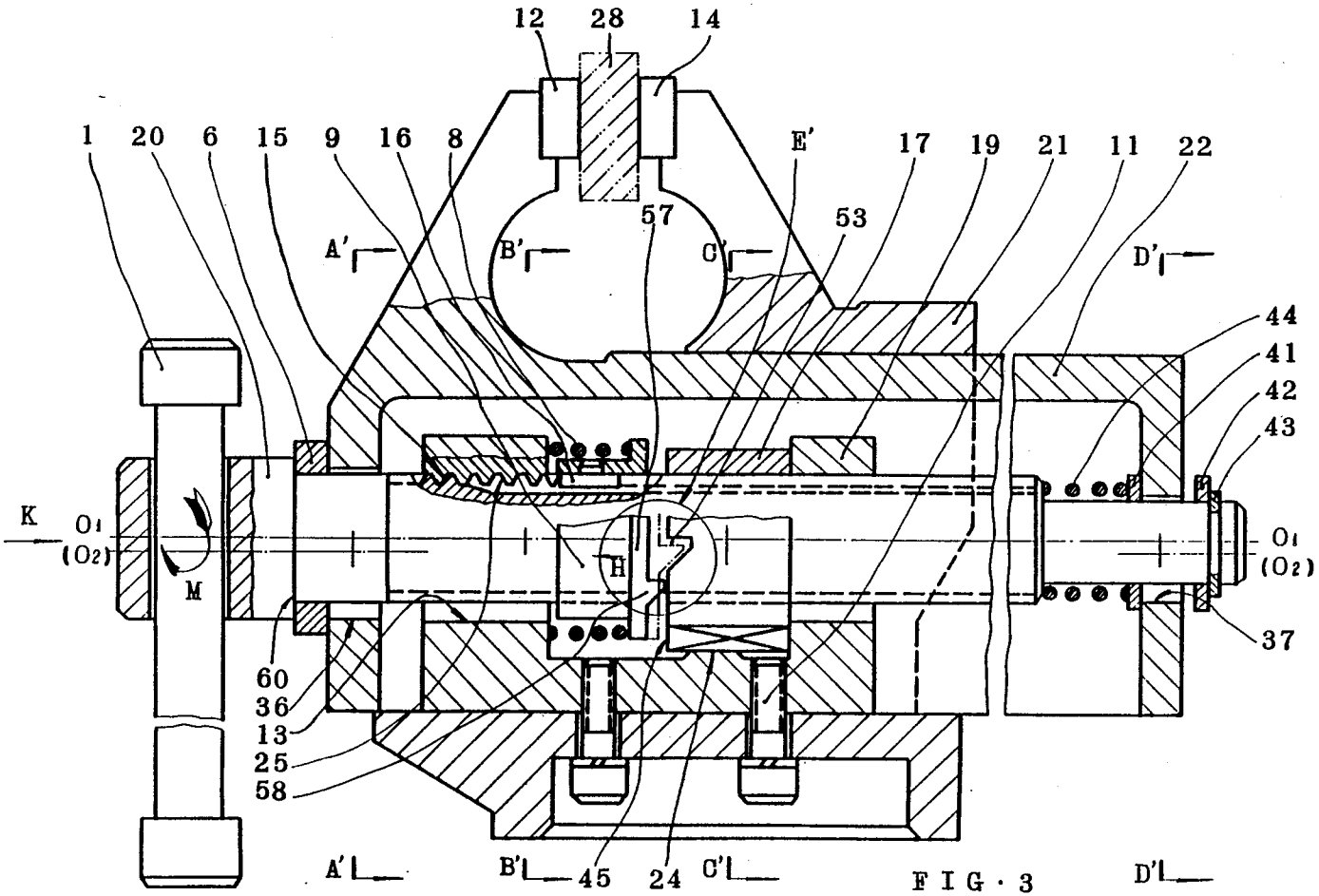
FIG. 3 is a sectional view of the bench vice in FIG. 2 but in position clamping a workpiece.

FIG. 8I is a sectional view taken from line A'A' and line D'D' of FIG. 3 showing a relative position of the screw neck journal in the support holes on the front and back vertical plate of the movable body, when the bench vice is in a position clamping a workpiece.

FIG. 8II is a sectional view taken from line B'B' of FIG. 3, showing a position where the outer threads of the screw engage with the inner threads of the screw nut seat when the bench vice is in a clamping position.

FIG. 8III is an orthogonal projection drawing of the local view E' showing the palw of ratchet sleeve having disengaged out from the pawl groove of the cam in FIG. 3 where the bench vice is in a clamping position.

FIG. 8IV is a sectional view of FIG. 3 taken from line C'C', showing a relative position of the eccentric cam and the screw nut seat when the bench vice is in a clamping position.

FIG. 9I is a view showing the device for feeding a workpiece in a manual feed miller employing the drive mechanism of the present invention.

FIG. 9II is a sectional view of FIG. 9I taken from line GG, showing a matching relation of the work sliding table and the work table seat.

Figure 10:
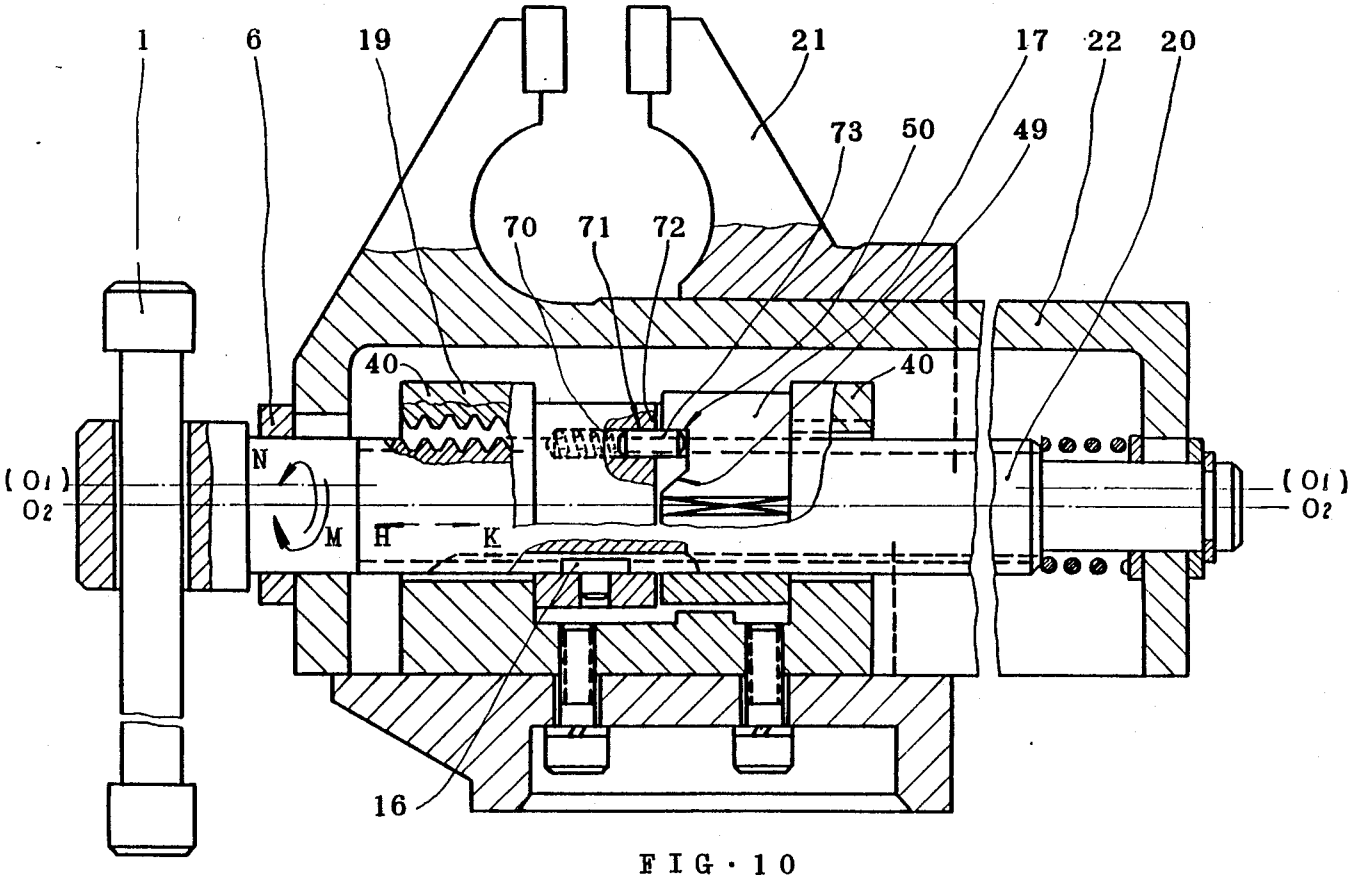

FIG. 10 illustrates one of the embodiments showing the variants in construction of FIG. 2, wherein the structure of the cylindrical compression spring and the pawl of the ratchet sleeve have been changed.

Figure 11:
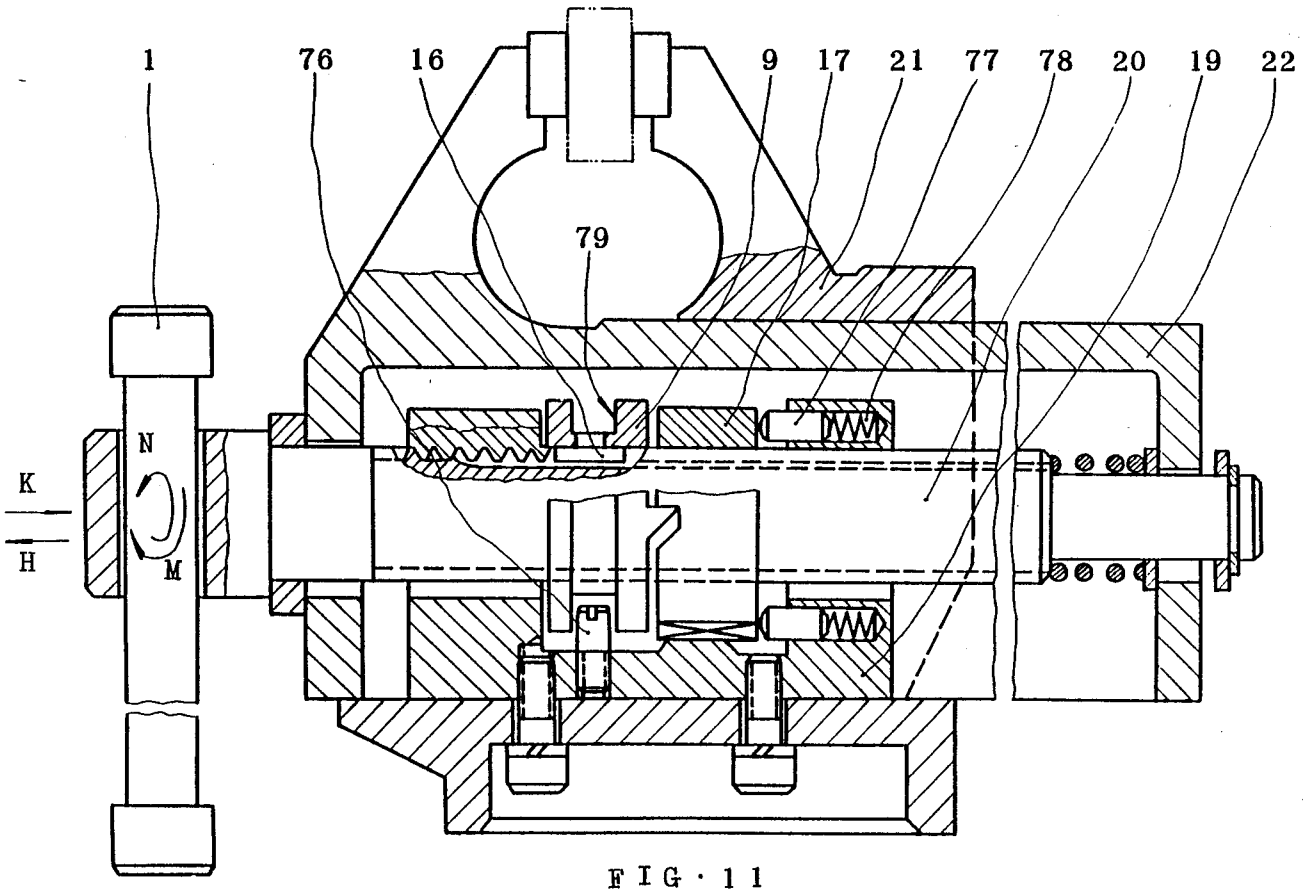

FIG. 11 illustrates another embodiment showing the variants in constraction of FIG. 2, wherein the way for applying pressure by the cylindrical compression spring and the position of point of application have been changed.

FIG. 12I illustrates a further ambodiment of the vice.

FIG. 12II in a perspective view of the screw nut seat of FIG. 12I.

FIG. 12III and IV are the sectional views of line Y—Y in FIG. 12I.

FIG. 2 shows an embodiment of the bench vice employing the drive mechanism with a vertical lift screw according to the present invention, which comprises a stationary body 21; a movable body 22; a pair of vice jaws 12, 14; a handle 1, a screw 20, an eccentric cam 17, a screw nut seat 19, a ratchet sleeve 9, a compression spring 8 and a gasket 6, etc, wherein the movable body 22 can slide along the guide track in the stationary table 21 and the handle 1 mounted in a through hole on left end of the screw 20 may cause the screw turning to left (Ndirection) or right (M-direction).

Two ends of the screw 20 are supported respectively in the support holes 7,23 on the front and back vertical plate of the movable body 22 and the two support holes 7,23 being all in a long-circular form permit the screw 20 able only to move up and down vertically. The gasket 6 is provided between an inner end surface 68 on a left projection of the screw 20 and an outer end surface of the support hole 7 on front vertical plate of movable body 22. At the right shoulder of the screw 20, there is provided a cylindrical compression spring 44, its an end through a gasket 41 bears against the inner side the back vertical plate of movable body 22 while the end of the right neck journal of screw 20 has a gasket 42 and a stop collar 43 to protect the neck journal from sliding off. In assembly, it should be ensured that there is a gap $\delta$ between the end surface 60 on left projection of the screw 20 and the end surface 61 of gasket 6. The width of $\delta$ is about $\frac{1}{2}$ of the pitch in screw 20. This $\delta$ is prepared for that when accidentally there happens the teeth touching against in an engagment of the threads 25 and 15 may bring the screw 20 to have a little axial movement freely and then a suitable engagement can be achieved.

The screw 20 being provided a key groove connects with the ratchet sleeve 9 through the guide key 16 and the screw 20 also penetrates the axial hole of the ratchet sleeve 9, in addition, the screw 20 has outer threads 25 (see FIG. 2 and 3).

The screw nut seat 19 is in the form of saddle (see FIG. 4I), which is fixed on the stationary body 21 by means of the bolts 11. The two arms 40 on the seat 19 have respectively the concentric holes 38. The cross-sectional shape of the holes 38 is formed with two circular arcs, i.e. The upper arc "arc" and the lower arc "b"(see FIG. 4II). The center of circle of the upper arc "a" is $O_1$ and the central angle $\alpha$ of the arc "a" is less than (or equal to)180°. The radius of the upper arc "a" is $r_1$ which equals to the thread radius of the outer threads 25 on screw 20. The surfaces on the upper arcs "a" of the two holes have respectively the inner threads 15 which can engage with the outer threads 25 of the screw 20. The center of circle of the lower arc "b" is $O_2$ which is beneath the center $O_1$ of the upper arc "a" and there is an eccentric distance "e" between the two centers $O_1$ and $O_2$. The "e" should be greater than the tooth depth of the threads 15, 25, meantime the radius $r_2$ of the lower arc "b" should be greater than the thread radius of outer threads on screw 20 in order to ensure that when the screw 20 descends from position $O_1$ to position $O_2$, it does not touch with any portions of the wall on the hole of seat 19 as shown in FIG. 7II and can displace freely along the axial direction of screw 20.

The eccentric cam 17 is positioned between a arm 40 and the sleeve 9. The curve for the cam is divided into a downward stroke curve portion (with the lowest point 32) and an upward stroke curve portion (with the highest point 31). In addition the cam 17 has also a positioning projection 52 and a positioning plane 51. In left turning, the positioning projection 52 will touch a horizontal limit plane 56 of the movable body 22, at this point, the lowest point 32 on the cam curve will just oppose the supporting surface 24 of seat 19 so as to cause the cam 17 and the screw 20 to situate in the most released position $O_2$ (see FIG. 7 IV). Similarly (see FIG. 8IV and FIG. 6) in right turning, the positioning plane 51 will touch the side wall surface 55 on the movable body 22, at this point, the highest point 31 on upward stroke curve portion of the cam 17 will touch the cam support surface 24, under an influence of the upward stroke curve of cam 17, causing the axis of screw 20 to ascend from position $O_2$ up to position $O_1$, so that the outer threads 25 engage with the inner threads 15 on the seat 19 (see FIG. 8II). There is provided on an end surface 45 of cam 17 one (or more) one-direction pawl groove 53 (see FIG. 8III), which has a vertical surface 50 and an oblique surface 49.

The ratchet sleeve 9 connects with screw 20 through the guide key 16 and has a flange 57 which is provided one(or more) one-direction Pawl 58 and the later has a vertical surface 47 and an oblique surface 48 (see FIG. 7III), under an action of the cylindrical compression spring 8 to ensure the ratchet sleeve 9 and the cam 19 to press together forever.

Now, the operation sequences of fast clamping bench vice according to the invention will be explained as follows. There are five steps wherein the second and third steps are simulaneous and the whole operating time is about one second; the fourth and fifth steps are also simulaneous and the whole operting time is about 0.5 second.

(1) The step for free adjustment of the opening in the jaws of a bench vice

Now the lowest point 32 on downword storke curve of the cam 17 faces on the cam supporting surface 24, the cam 17 is in a released position relative to the cam supporting surface 24 of the screw nut seat 19 (see FIG. 7IV). The front end and the back end of the screw 20 are supported respectively on the lower supporting surfaces 36 and 37 of the supporting holes 7 and 23 on the front and back vertical plates of the movable body 22 (see FIG 7I), meantime, the positions of the supporting holes 7 and 23 ensure the central axis of the screw 20 to be at the center $O_2$ of the lower arc "b", while the outer threads 25 on screw 20 does not contact with the inner surfaces on the holes 38 of the seat 19 in any portion (see FIG. 7II), thus the movable body 22 may be pushed or pulled manually such that the movable body 22 can slide quickly along the guide track in the stationary body 21 with the screw 20 to fast adjust the opening S of the vice jaws according to the size of a workpiece. Depending on the size of workpiece 28, the process for pushing the movable body in a suitable position to cause the jaws 12, 14 in contacting with the workpiece 28 will take about 0.5–1 second.

(2) The step for engaging the outer threads of screw with the inner threads of seat Turning handle 1 along the right-hand direction (shown as the arrow M in FIG. 3) to rotate the screw 20, the screw 20 through the quice key 16 drives also the ratchet sleeve 9 to turns right, meanwhile, the pawl 58 of ratchet sleeve 9 is in a pawl groove 53 of the cam 17, a right turning of the ratchet sleeve 9 causes the oblique surface 48 of pawl 58 to bear against the oblique surface 49 of pawl groove 53 (see the position designed by double dash line in FIG. 8III), thus, under the action of an axial force from the compression spring 8, by a push of the oblique surface 48 on ratchet sleeve 9, the cam 17 turns also to right, then brings its upward stroke curve to slide on the cam supporting surface 24 of the screw nut seat 19 until the position plane 51 of cam contacts with the limit surface 55 to cease the cam in rotation(see FIG. 8IV), at the same time, the highest point 31 on upward stroke curve of the cam 17 just touches the supporting surface 24 of the seat 19 and the screw 20 also lifts vertically to a highest position, i.e., the central axis of screw 20 ascends over an eccentric distance "e" from its original position $O_2$—$O_2$ to a position $O_1$—$O_1$, until the outer threads 25 of screw 20 engages with the threads 15 in the holes 38 of seat 19 and the engagement should ensure to have some gap to allow the pair of the inner and outer threads 15, 25 turning freely relative each other (see FIG. 8-II)

(3) The step for clamping a workpiece (see FIG. 3)

Continuing to turn the handle 1 along the righthand direction (shown as the arrow M) Now, since the positioning plane 51 of the cam 17 has touched the sidewall limit surface 55 of movable body 22 and causes the cam 17 ceasing in rotation (see FIG. 8-IV), the rotative moment of the ratchet sleeve 9 will apply to oblique surfaces 48 and 49 belonging to the pawl 58 and pawl groove 53 having been contacted each other, which generates an axial component along the direction "H". When the axial component is greater than the axial pressure of spring 8, the ratchet sleeve 9 displaces along the direction "H", until the pawl 58 leaves out from pawl groove 53 and slides along the end surface 45 of cam 17. Still continue to turn the handle. Since the outer threads 25 of screw 20 has engaged with inner threads 15 of seat 19 with the threards being righthanded and the seat 19 is fixed on the ststionary body 21, the screw 20 moves forward along the axial direction "K" while it turns to right. Thus, the screw 20 through the end surface 60 on its left projection and the gasket 6 pushes the movable body 22 to displace until the jaws 12, 14 clamp the workpiece 28.

(4) The step for releasing a workpiece

After the workpiece has been processed and requires to be removed, turn the handle 1 in a lefthand direction (Ndirection, see FIG. 2) and cause the screw 20 to rotate according to the left-hand direction. Since the outer threads 25 of screw 20 are initially in engagement with the inner threads 15 of seat 19, the screw 20 displaces axially along the direction "H" while turns to left and through the gasket 42 and stop collar 43 pushes the movable body 22 to displace along direction "H" so as to cause the jaws to release the workpiece 28.

(5) The step for disengaging the outer threads of screw from the inner threads of seat (see FIG. 2)

At a time in releasing the wordpiece, i.e., a time when the handle 1 turns to left, the ratchet sleeve 9 driven by the screw 20 and guide key 16 also turns to left by a certain angle until the pawl 58 falls into pawl groove 53 (see FIG. 7III) under the pressure of the compression spring 8. Since the pawl is of one-direction clutch type, the screw 20 drives the ratchet sleeve 9 to continue its left turn, and pushes the cam 17 to turn in lefthand direction through two vertical surface 47 and 50 respectively on the pawl and plaw groove, causing the cam gradually into a released position, i.e., causing the lowest point 32 on the downward stroke to turn gradually to its lowest position (see FIG. 7IV) until the positioning projection 52 of cam 17 contacting with the horizontal limit plane 56, thus applying a downward componental force W to screw 20 and forcing the central axis of screw 20 to descend from position $O_1$ to position $O_2$, just dropping a height "e", hence disengaging the outer threads 25 of screw 20 wholly from the inner threads 15 of seat 19. Now, the front end and the back end of screw 20 fall respectively on the lower supporting surface 36, 37 of the supporting holes on the front and back vertical plate of the movable body 22 (see FIG. 7I). Therefore, the screw 20 may displace forward or backward freely with the movable body 22 and causes the screw driving mechanism again in a manner that the opening in vice jaws 12, 14 can be fast adjusted as described in the step 1.

FIG. 9 shows an embodiment of processing a workpiece by a manual operating miller employing the screw-lifting drive mechanism according to the present invention, which can achieve the following three manual sequences, a fast feed idle stroke, a slow feed in "work feed"0 and a fast retraction after the workpiece having been processed. It is simple in construction and greatly improves the efficiency. It comprises a movable table 64, a stationsry worktable 68, a mill 67, a clamper 65 for a workpiece 66 and a hand wheel 63. The workpiece 66 is firmly clamped by the clamper 65 and the later is mounted on a T-shaped groove of the movable table 64. During the operation, require the movable table 64 with the clamper 65 to load or unload the workpiece 66 at a station I. Then require to fast manually an idle stroke SQ to a station II. Subsequently, the movable table 64 loaded with the workpiece 66 begins the "work feed" "SW", and after the mill 67 processing the surface of the workpiece 66, attains to a station III. Meanwhile, the mill 67 is lifted and manually fast retract the movable table 64 with the workpiece 66 to the station I, unloading the workpiece and completing an operation cycle. Here, the miller employs the drive mechanism with a vertically lifting screw according to the present invention and the principles of operation are essentially the same as in the embodiment of the bench vice illustrated in FIGS. 2 and 3, such as the movable table 64 and the worktable 68 in here correspond respectively to the movable body 22 and the stationary body 21 in the bench vice of FIGS. 2 and 3. The idle stroke SQ and the work stroke SW in this embodiment correspond respectively to the fast asjusting step for the opening of the jaws and the clamping step. When the worktable 64 of the miller has a longer work stroke, the length of screw 20 is necessary longer. In order to protect the screw 20 from a too great deformation during its lifting movement, a similar ratchet sleeve and cam mechanism operating symchronistically may be added on a suitable position on the Screw 20.

According to the above description, the novel screw drive mechanism according to the present invention allows to quickly adjust the distance between the movable body and the stationary body or to fast pass over the idle stroke of the worktable based on different size of the workpieces of their relative positions, hence to improve efficiency and simplify the construction.

FIG. 10 shows one of the embodiments in of the modification. In FIG. 10, instead of the pawl 58 and the compression spring 8 in FIG. 2, a cylindrical pin 73 and a spring 70 are mounted in a hole of an end surface on the ratchet 72. Their performances are equivalent. In FIG. 11, instead of the compression spring 8, there are provided a guide pole 77 and a small cylindrical compression spring 78 in a circular hole on the end surface of the screw nut seat. In order to protect the ratchet sleeve 9 from an axial movement, there is provided on the ratchet sleeve 9 in FIG. 11 a recess 79 and mount a stop pin 76 in the recess. FIG. 12 illustrates another embodiment of the vice, in which the holes of screw nut seat 85 are in the form of lower semi-hole with the threads 15; the ratchet sleeve 9 is replace by a one-direction pawl pin 86 having a vertical surface 87 and an oblique surface 88, the pin 86 in provided with two grooves 89 on its another end; the cam 90 has a radial hole 91 and has two grooves 92 along the cam's circumference, the pawl pin 86 is located into the hole 91; Two ring extension springs 99 are located around the grooves 89 and 92. The screw 93 is provided along its axial direction with two one-direction pawl grooves 94 having a vertical surface 95 and an oblique scurface 96. When the vice is in a released position, the screw 93 is at its highest position ($O_1$—$O_1$), and the threads 25 on the screw disengages with the threads 15 on seat 85, the pawl of pin 86 falls into the pawl groove 94 of the screw under the action of ring exteusion springs 99. For clamping a workipece,, turn the screw 93 in the right-hand direction, the screw 93 drives the cam 90 by two oblique surfaces 88 and 96 contacted each other, due to the movable body has also a upper plane 97 which touches with the curve of cam 90, the cam 90 causes the screw 93 to descend from its highest position $O_1$—$O_1$ to its lowest position $O_2$—$O_2$ under the action of two planes 97 and 98, thus the threads 25 on screw engage with the threads 15 of the seat 85, continuing to turn the handle, the pawl will overcomes the force of ring extension springs and slides off from the pawl groove 94, so the screw 93 can turn continuously to clamp the workpiece. For releasing the workpiece, turn the screw 93 in lefthand direction, the pawl pin 86 falls into pawl groove under the action of ring extension springs, thus the screw 93 drives the cam 90 to rotate by two vertical surfaces 87 and 95 contacted each other. Under the action of two planes 97 and 98, the cam 90 ascends the screw 93 from its lowest position $O_2$—$O_2$ to its highest position $O_1$—$O_1$, thus the thread 25 disengages with the threads 15, and the opening of vice can adjust freely. Two projections 100 and 101 respectively on the movable body and the seat 85 cease the cam to rotate when the end of pin 85 touches with them. (see FIG. 12III and IV)

The mechanism may have a variety of medifications in stucture, which should be considered within the scope of the present invention.

I claim:

1. A vertical-lift screw drive mechanism comprising a stationary body, a movable body, a screw, a screw nut seat in the form of a saddle, the nut seat having a hole therethrough and having cam support surfaces thereon, an eccentric cam positioned between two arms of said nut seat, said cam having a hole therethrough, said screw disposed in the holes of said nut seat and said cam, said cam slideably supported on the cam support surfaces of said nut seat, a one-direction ratchet device positioned between said screw nut seat and said eccentric cam, said ratchet device connected to said screw such that said screw drives said eccentric cam to rotate by said one-direction ratchet device, which causes a vertical movement of said screw whereby said screw engages with or disengages from the nut seat.

2. The screw drive mechanism according to claim 1 wherein said one-direction ratchet device is a ratchet sleeve, positioned between an arm of said screw nut seat and an end surface of said eccentric cam, a guide key provided for connecting the screw to the ratchet sleeve and further comprising a one-direction pawl provided on the end surface of the ratchet sleeve, a one-direction pawl groove correspondingly provided on the end surface of the eccentric cam, the pawl being formed by a vertical surface and an oblique surface, a spring provided for biasing the ratchet sleeve and the end surface of the cam together along an axial direction.

3. The screw drive mechanism according to claim 1 wherein said screw has a threaded outer surface and said screw nut seat has matching inner threads on the holes thereof such that during upward displacement of the screw, the threaded outer surface engages the inner threads of the nut seat to clamp a workpiece, and during a downward displacement, the threaded outer surface disengages from the inner threads of the nut seat.

4. The screw drive mechanism according to claim 3 further characterized by said eccentric cam having a one-direction pawl groove formed by a vertical surface and an oblique surface and having a positioning projection for touching a horizontal limit plane of the stationary body, providing the lowest point on a downward stroke of the cam such that the screw attains its lowest position, and disengages the inner and outer threads; and further comprising a position plane on the cam for touching with a vertical limit side surface of the movable body, providing the highest point on an upward stroke of the cam to contact with the cam support surface on the screw nut seat to force the screw to ascend to its highest position, such that the outer threads of the screw engage with the inner threads of the seat in a rotatable manner.

5. The screw drive mechanism according to claim 1 characterized by the screw nut seat being fixed on the stationary body, the two arms of the nut seat having concentric axial holes, each hole having an upper circular arc and a lower circular arc, the central angle of the upper circular arc being less than or equal to 180° and the radius of the upper circular arc being equal to the radius of the outer threads on the screw, a fitting surface of the upper circular arc having inner threads suitable to engage with other threads on the screw, a center of the lower circular arc positioned beneath a center of the upper circular arc, the radius of the lower circular arc being greater than the radius of outer threads on the screw and the eccentric distance between the centers of the two circular arcs being greater than the tooth depth of the screw threads.

6. The screw drive mechanism according to claim 1 characterized by a spring, a gasket and a stop collar forming an assembly disposed between a right end neck journal of the screw and a back vertical plate of the movable body, a gap provided between the end surface on a left projection of the screw and an end surface of the gasket on a side surface of the movable body.

7. A bench vice employing the screw drive mechanism according to claim 1 characterized by the bench vise having a stationary jaw and a movable jaw, the screw drive mechanism disposed in the bench vice, the stationary body being the stationary jaw and the movable body being the movable jaw.

8. A bench vice employing the screw drive mechanism according to claim 2 characterized by the bench vise having a stationary jaw and a movable jaw, the screw drive mechanism disposed in the bench vice, the stationary body being the stationary jaw and the movable body being the movable jaw.

9. A bench vice employing the screw drive mechanism according to claim 3 characterized by the bench vise having a stationary jaw and a movable jaw, the screw drive mechanism disposed in the bench vice, the stationary body being the stationary jaw and the movable body being the movable jaw.

10. A bench vice employing the screw drive mechanism according to claim 4 characterized by the bench vise having a stationary jaw and a movable jaw, the screw drive mechanism disposed in the bench vice, the stationary body being the stationary jaw and the movable body being the movable jaw.

11. A bench vice employing the screw drive mechanism according to claim 5 characterized by the bench vise having a stationary jaw and a movable jaw, the screw drive mechanism disposed in the bench vice, the stationary body being the stationary jaw and the movable body being the movable jaw.

12. A bench vice employing the screw drive mechanism according to claim 6 characterized by the bench vise having a stationary jaw and a movable jaw, the screw drive mechanism disposed in the bench vice, the stationary body being the stationary jaw and the movable body being the movable jaw.

13. The bench vice according to claim 7 characterized by an end surface of the ratchet sleeve having a circular hole, a guide pin and a compression spring disposed within the hole.

14. The bench vice according to claim 7 characterized by an inner side end surface of the screw nut seat having a circular hole, a guide pole and a compression spring disposed within the hole, and a stop pin mounted on the screw nut seat.

15. A worktable of a tool employing the screw drive mechanism according to claim 1 further comprising a second one-direction ratchet sleeve and a second cam mechanism located on the screw and operate synchronously with the ratchet sleeve and cam mechanism.

16. A worktable of a tool employing the screw drive mechanism according to claim 2 further comprising a second one-direction ratchet sleeve and a second cam mechanism located on the screw and operate synchronously with the ratchet sleeve and cam mechanism.

17. A worktable of a tool employing the screw drive mechanism according to claim 3 further comprising a second one-direction ratchet sleeve and a second cam mechanism located on the screw and operate synchronously with the ratchet sleeve and cam mechanism.

18. A worktable of a tool employing the screw drive mechanism according to claim 4 further comprising a second one-direction ratchet sleeve and a second cam mechanism located on the screw and operate synchronously with the ratchet sleeve and cam mechanism.

19. A worktable of a tool employing the screw drive mechanism according to claim 5 further comprising a second one-direction ratchet sleeve and a second cam mechanism located on the screw and operate synchronously with the ratchet sleeve and cam mechanism.

20. A worktable of a tool employing the screw drive mechanism according to claim 6 further comprising a second one-direction ratchet sleeve and a second cam mechanism located on the screw and operate synchronously with the ratchet sleeve and cam mechanism.

21. A bench vice employing the screw drive mechanism according to claim 1 wherein said one-direction ratchet device is a one-direction pawl pin having a vertical surface and an oblique surface; and further comprises ring extension springs; the holes of said screw nut seat being in the form of a lower semi-hole with threads, the cam having a radial hole for receiving said pawl pin; the pawl pin and cam having grooves for receiving said ring extension springs; the screw have one-direction pawl grooves having a vertical surface and an oblique surface; the movable body having an upper plane which touches with a curve of the cam.

* * * * *